US005593159A

United States Patent [19]

Otake

[11] Patent Number: 5,593,159

[45] Date of Patent: Jan. 14, 1997

[54] RESTRAINING BATON AND STRAP

[75] Inventor: Ben Otake, Glendale, Calif.

[73] Assignee: Nobutake Enterprises, Inc., Carpenteria, Calif.

[21] Appl. No.: 516,871

[22] Filed: Aug. 18, 1995

[51] Int. Cl.[6] ..... A63B 15/02

[52] U.S. Cl. ..... 463/47.2; 70/15

[58] Field of Search ..... 273/84 R, 84 A; 70/84 ES; 242/15, 16, 376.1, 379.2, 400, 405.3; 128/846; 224/914

[56] References Cited

U.S. PATENT DOCUMENTS

| | | | |
|---|---|---|---|
| 2,493,345 | 1/1950 | Harmon | 242/400 |
| 4,748,937 | 7/1988 | Musetti | 242/405.3 |
| 4,819,137 | 4/1989 | Hamilton | 273/84 R |
| 4,915,320 | 4/1990 | Neal | 242/405.3 |
| 5,251,464 | 10/1993 | Halter | 243/379.2 |

FOREIGN PATENT DOCUMENTS

| | | | |
|---|---|---|---|
| 0070065 | 10/1949 | Germany | 242/400 |

*Primary Examiner*—William M. Pierce
*Attorney, Agent, or Firm*—George J. Netter

[57] ABSTRACT

A combination baton (11) and hand grip (18) is unitized as (10). A strap (12) extends through an opening (44) in a canister (14) which is rotatably mounted onto the baton (11). To extend the strap (12), a thumb of one hand is placed in thumb ring (46) and the strap pulled outwardly from the canister (14) by the other hand. To store the strap, a thumb is inserted into the thumb ring (46) and the other hand rotates the baton (11). An alternative embodiment has the storage housing (60) rotatably mounted to the baton shaft (54) by a pair of cylindrical rings (62) affixed to the shaft by threaded members (64).

6 Claims, 2 Drawing Sheets

3B
3B
12
14
22
24
26
27
30
32
34
36
38
40
42
44
46
48
50
52
54
56
58
60
62
64

RESTRAINING BATON AND STRAP

BACKGROUND

1. Field of the Invention

The present invention relates generally to a restraining baton as used by peace officers, and, more particularly, to such a restraining baton of improved character with a unitary strap for aiding in the subduing of an individual.

2. Description of Related Art

It is well known to use an elongated rod as a means for subduing or restraining an individual with the device being conventionally constructed of wood or metal and made in various lengths. Length and overall construction varies depending upon the ultimate use to which the device is to be put. More particularly, and with respect to what we are primarily concerned with here, a night stick or baton as utilized by peace officers and security officers is of an overall length not exceeding about 2½ feet which is readily adaptable to being carried while, say, on foot patrol, may be quickly brought into use, and can be carried in an automobile without taking up too much room.

It is also known to restrain an individual by tying with rope, thongs or elongated strands of material extending about the individual with securement of restraint effected the ends of the strand etc. being tied together. Temporary binding with cordlike means without knotting or use of fastening means is also known. See in this latter connection U.S. patent to Wong U.S. Pat. No. 4,386,605.

It is, therefore, a desideratum to provide a restraining baton including a strap that is affixed to the baton and readily extendible for use and stowed in out-of-the-way condition when not needed. In this manner, the capabilities of both the baton and the strap, individually and used together, are provided without the inconvenience of separate storage needs and availability for immediate use of each being insured.

SUMMARY OF THE INVENTION

A primary object and aim of the present invention is to provide restraining apparatus having both a shaft or baton and length of flexible strap integrally related thereto for providing additional restraining capabilities.

A further object as in the previous object includes a canister mounted onto the baton within which the strap can be stored when not in use.

In accordance with the practice of the present invention there is provided a night stick or baton having a gripping end portion with a unitary elongated rod member extending therefrom for levering or otherwise contacting an individual in connection with subduing measures taken such as by a peace officer, for example. The elongated rod may be constructed in a manner enabling collapsing the overall length to a more convenient shorter size. A hollow cylindrical housing or canister is rotatably mounted onto the baton in the region defining the separation between the gripping end portion and the rod member. An elongated flexible strap of woven textile, for example, has one end portion extending outwardly through a slot in the canister and its other or inner end affixed to the baton rod member.

A thumb ring is rotatably affixed to the outer surface of the canister and, as the name implies, provides a means of holding the baton by receiving the thumb therethrough. Also, on holding the baton of this invention solely by the thumb ring with one hand, the other hand is used to pull the strap from the canister for use.

DESCRIPTION OF A PREFERRED EMBODIMENT

Figure 1:
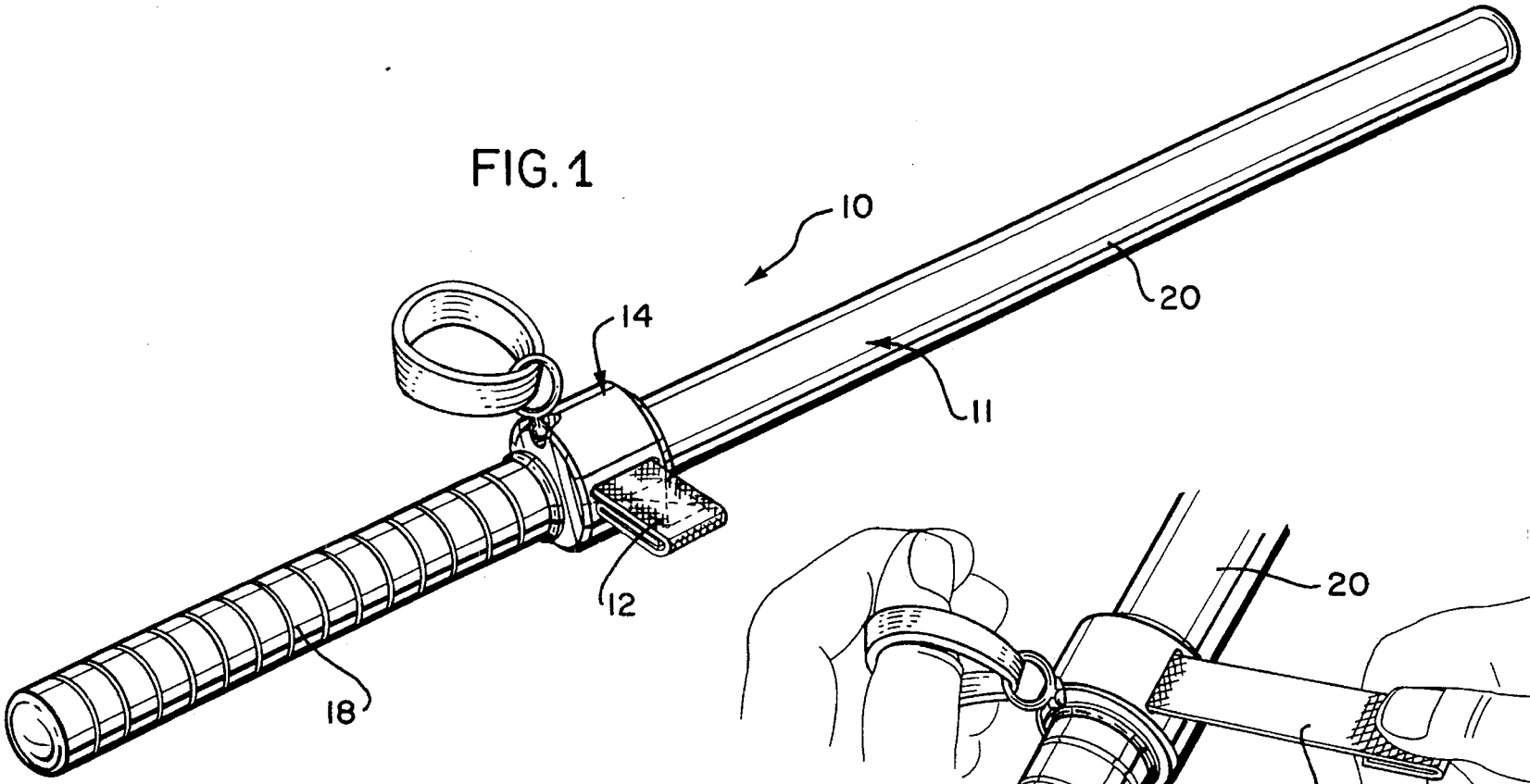
FIG. 1 is a perspective view of the present invention showing the strap in stored condition.
Figure 2:
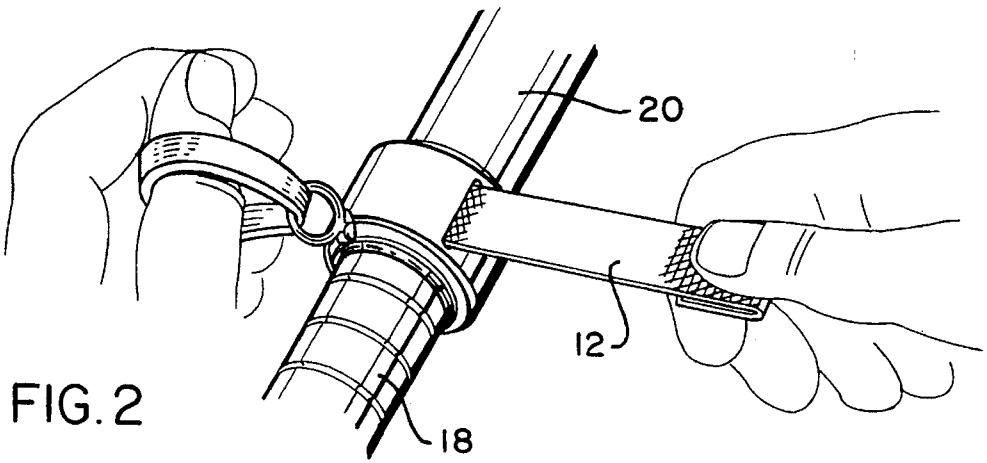
FIG. 2 is a perspective view of the restraining apparatus of the present invention shown with strap appended thereto and extended in use mode.

Turning now to the drawings and particularly to FIGS. 1 and 2, there is shown restraining apparatus of the present invention enumerated generally as 10. As will be described in greater detail later, the apparatus includes generally an elongated shaft (e.g., baton 11 and a flexible strap 12 that can be selectively retracted into a canister 14 for storage and extended outwardly of the canister for use (FIG. 2).

The baton or shaft 11 can be constructed of a number of different materials having sufficient strength and rigidity to withstand restraining functions. For example, typical materials that may be found satisfactory for constructing the baton are wood, solid metal such as aluminum, and certain plastics such as ABS. The shaft has a relatively short portion 18 which is preferably configured with an outer surface that is either roughened or provided with suitably dimensioned ridges for serving as a hand gripping section.

The remaining part of the shaft 11 enumerated generally as 20 is preferably substantially longer than the grip portion 18 and is used primarily for contacting an individual for restraint purposes.

Figures 3A, 3B, 4:
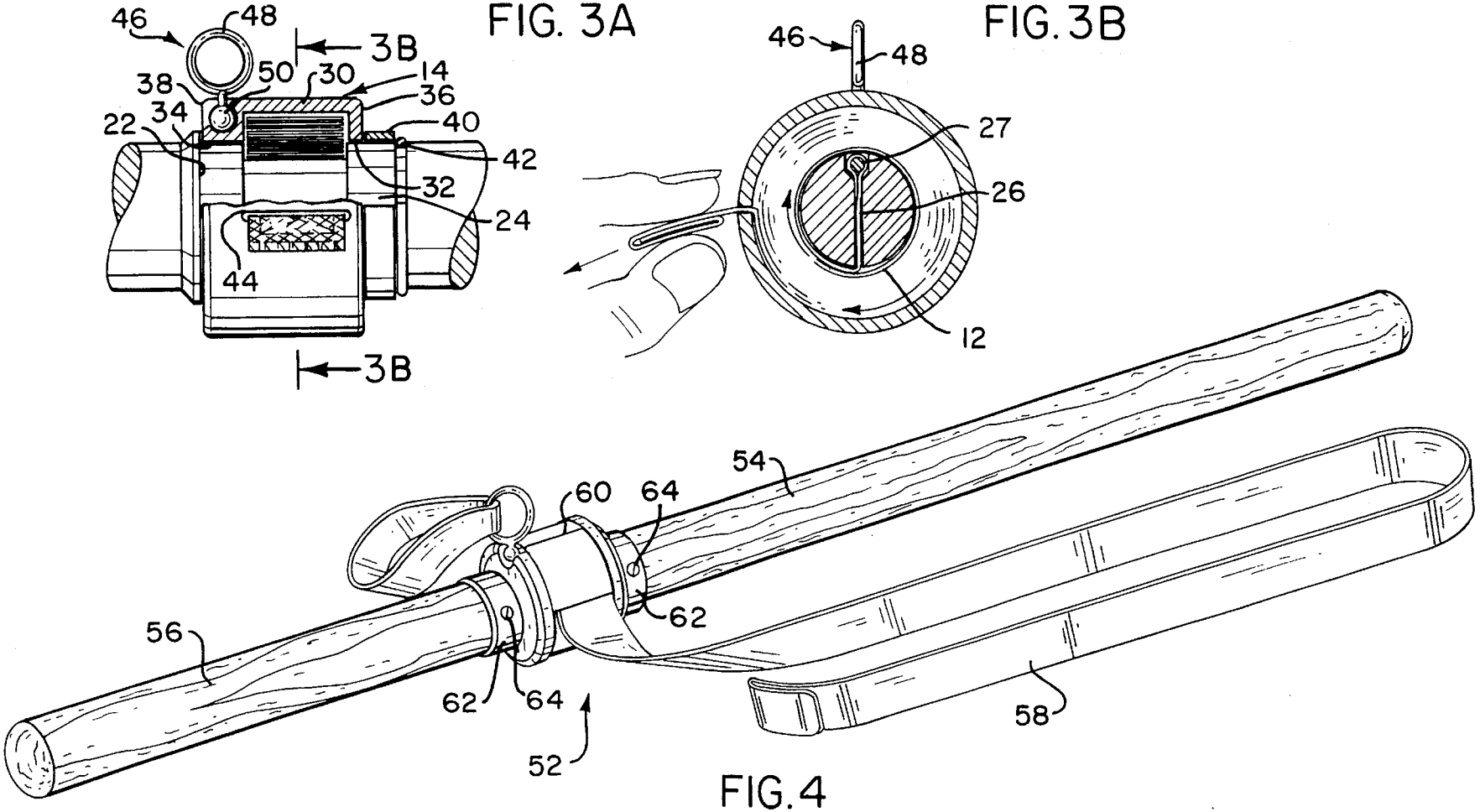
FIGS. 3A and 3B are sectional elevational views through the strap storage canister.
FIG. 4 is an alternative embodiment of the invention shown in perspective.

Inwardly from the grip portion 18, the shaft cross-section is reduced radially to form a shoulder 22 and lesser diameter shaft region 24 extending slightly toward the grip portion (FIG. 3A). In this lesser diameter shaft portion 24, there is also provided a slot-like opening 26 which extends transversely completely through the shaft body and which opening is of such dimensions as to enable sliding receipt of an end portion of the strap 12 therethrough (FIG. 3B). For assembly an end portion of the strap 12 is passed through the opening 26 and trapped therein by an oversize dowel 27 secured to the strap end.

A storage housing or canister 14 includes a hollow cylindrical shell 30 (e.g., metal or plastic) having openings 32 and 34, respectively, in its two circular end faces 36 and 38. More particularly, these openings are of such dimensions as to provide sliding receipt over the gripping portion 18 and with canister wall portions abutting against the shoulder 22 as shown in FIG. 3A. A washer 40 and O-ring 42 contact the outer end face 36 of the canister and secure it in a unitary relation to the baton or shaft 16. The circumferential outer wall of the canister also has a slot-like opening 44 extending generally parallel to the canister cylindrical axis and of sufficient dimensions to enable ready sliding receipt of the strap 12 therethrough.

Thumb ring means 46 includes a circular loop 48 which is affixed to the housing shell 30 via a pivot device 50 enabling 360 degree turning about a diametral axis as well as tilting angularly thereto. The pivot gives the means 46 a generally universal mounting feature such that when held with a thumb inserted in the loop 48 the shaft or baton may be rotated with respect to the loop. Also, the loop makes gripping of portion 18 more secure and reduces the possibility of dropping. Still further, the thumb ring means 46 is usefully employed in withdrawing the strap 12 from the canister as will be described.

In use of the invention, assume initially that the strap 12 is completely stowed away in the canister as depicted in FIG. 1. Normal use of the baton 11 alone may be accomplished in the conventional manner with the stored strap providing no hindrance of any kind.

To use the strap, a thumb is inserted in the thumb ring means 46 and holding the device 10 in that way, or alternatively clasping the canister with one hand, the outer end of the strap 12 is pulled with the free hand until the full length of the strap extends outwardly of the canister 14. The strap and baton may now be used together for restraining purposes.

Turning now to FIG. 4 there is depicted an alternative embodiment enumerated generally as 52 including a unitary shaft member 54 with an end portion 56 configured to serve as a hand grip. A strap 58, which can be the same as the strap 12 of the first embodiment, extends through a slot in a peripheral wall of a hollow storage housing 60 with the inner strap end being affixed to shaft member 54. Housing 60 may be the same as Canister 14 except that after being slidingly located on the member 54 the housing is held in place along the member by a pair of cylindrical rings 62, one on each side off, he housing, the latter fixedly positioned on the member 54 by one or more threaded means 64, for example. The housing is rotatable about the shaft as in the first embodiment such that holding the housing with one hand and turning the shaft with the other hand winds the strap onto the shaft within the canister.

In the descriptions of the various embodiments, the baton shafts and hand grips have all been presented as one-piece rigid constructions. There are known baton arrangements which are selectively collapsible to a more convenient storage size, and then readily expandible for use. It is contemplated that this invention may be equally advantageous with a collapsible/expandible baton.

Although the present invention has been described in connection with preferred embodiments, it is to be understood that those skilled in the appertaining art may effect changes that come within the scope of the invention disclosed and within the ambit of the appended claims.

What is claimed is:

1. A restraining apparatus, comprising:

an elongated shaft including a hand grip portion at one end, a strap having one end affixed to the shaft, at a point other than at the hand grip portion, and a strap other end being left unattached;

a hollow storage canister having a first open end, a second open end and a slot therein and mounted onto the shaft such that the shaft extends through the canister and its open ends in a surrounding relationship to the affixed strap end such that the strap extends through the slot to an outside portion of the canister, wherein said strap can be rolled about the shaft and stored within the canister during nonuse;

a circular shoulder extending about the shaft and abutting a surface of the canister near the first open end; and a circular washer extending about the shaft and abuts against a surface of the canister near the second open end.

2. Restraining apparatus as in claim 1, in which a thumb ring is mounted to said canister.

3. Restraining apparatus as in claim 2, in which the canister is generally cylindrical and said first and second open ends are in each of two circular end walls respectively and are of such dimensions as to enable sliding receipt onto the shaft and rotation thereabout; said canister of the canister circumferential surface between each of the circular end walls where said slot opening is located and through which the strap slidingly passes with an end of the strap within the canister being affixed to the shaft.

4. Restraining apparatus as in claim 1, in which the shaft includes an opening at a point where the strap is affixed to the shaft through which the strap one end passes, and an oversize dowel is affixed to the strap one end preventing withdrawal of the strap from the shaft opening.

5. Restraining apparatus as in claim 1, in which the shaft includes several telescopingly related parts such that the shaft is selectively collapsible from a first maximum length to a second lesser length.

6. A restraining apparatus, comprising:

an elongated shaft including a hand grip portion at one end;

a strap having one end affixed to the shaft, at a point other than at the hand grip portion, and a strap other end being left unattached;

a hollow storage canister having a first open end, a second open end and a slot therein and mounted onto the shaft such that the shaft extends through the canister and its open ends in a surrounding relationship to the affixed strap end such that the strap extends through the slot to an outside portion of the canister, wherein said strap can be rolled about the shaft and stored within the canister during nonuse;

first and second cylindrical members received on the shaft and abutting respectively against a surface of the canister near the first open end and a surface of the canister near the second open end; and threaded means securing said first and second cylindrical members to said shaft.

* * * * *